US008747701B2

(12) United States Patent
Takeyama et al.

(10) Patent No.: US 8,747,701 B2
(45) Date of Patent: Jun. 10, 2014

(54) ELECTROCONDUCTIVE RUBBER COMPOSITION FOR ELECTROPHOTOGRAPHIC APPARATUSES AND CHARGING ROLLER FOR USE IN ELECTROPHOTOGRAPHIC APPARATUSES MANUFACTURED USING THE SAME

(75) Inventors: Kadai Takeyama, Komaki (JP); Takenori Saito, Komaki (JP); Naoaki Sasakibara, Komaki (JP); Keiichi Ikegami, Komaki (JP)

(73) Assignee: Tokai Rubber Industries, Ltd., Aichi (JP)

( * ) Notice: Subject to any disclaimer, the term of this patent is extended or adjusted under 35 U.S.C. 154(b) by 544 days.

(21) Appl. No.: 13/194,476

(22) Filed: Jul. 29, 2011

(65) Prior Publication Data

US 2012/0025143 A1 Feb. 2, 2012

(30) Foreign Application Priority Data

Jul. 30, 2010 (JP) ..... 2010-172282
May 30, 2011 (JP) ..... 2011-120443

(51) Int. Cl.

| | |
|---|---|
| ***H01B 1/00*** | (2006.01) |
| ***G03G 15/02*** | (2006.01) |
| ***H01B 1/12*** | (2006.01) |
| ***H01B 3/00*** | (2006.01) |
| ***G03G 15/20*** | (2006.01) |

(52) U.S. Cl.

CPC ..... *H01B 1/122* (2013.01); *H01B 3/004* (2013.01); *G03G 15/2057* (2013.01)

USPC ..... 252/500; 399/176

(58) Field of Classification Search

None

See application file for complete search history.

(56) References Cited

U.S. PATENT DOCUMENTS

| | | | | |
|---|---|---|---|---|
| 7,727,135 | B2 * | 6/2010 | Urano et al. | 492/56 |
| 2010/0028792 | A1 * | 2/2010 | Otake et al. | 430/73 |

FOREIGN PATENT DOCUMENTS

| | | | |
|---|---|---|---|
| EP | 2065761 | A1 | 6/2009 |
| JP | 2001-279104 | A | 10/2001 |
| JP | 2002-132020 | A | 5/2002 |
| JP | 2008-019249 | A | 1/2008 |
| JP | 2008-031157 | A | 2/2008 |
| JP | 2008-202722 | A | 9/2008 |
| JP | 4392745 | B2 | 1/2010 |

* cited by examiner

*Primary Examiner* — Harold Pyon
*Assistant Examiner* — Jaison Thomas
(74) *Attorney, Agent, or Firm* — Westerman, Hattori, Daniels & Adrian, LLP

(57) ABSTRACT

The charging roller has a base layer formed of an electroconductive rubber composition containing (a) a polar rubber having an unsaturated bond or an ether bond, (b) an ion carrier containing one or more phosphonium salts selected from the group consisting of phosphonium salts having the formulae (1) and (2), and (c) a cross-linker, wherein the amount of (b) component ranges from 0.1 to 10 parts by mass per 100 parts by mass of the (a) component. The formula (1) represents $[(H_9C_4)_3(C_nH_{2n+1})P]+(CF_3SO_2)_2N$—, and the formula (2) represents $[(H_9C_4)_3(C_nH_{2n+1})P]+(CF_3SO_3)$—.

3 Claims, 2 Drawing Sheets

ELECTROCONDUCTIVE RUBBER COMPOSITION FOR ELECTROPHOTOGRAPHIC APPARATUSES AND CHARGING ROLLER FOR USE IN ELECTROPHOTOGRAPHIC APPARATUSES MANUFACTURED USING THE SAME

BACKGROUND OF THE INVENTION

1. Field of the Invention

The present invention relates to an electroconductive rubber composition for electrophotographic apparatuses suitable for forming a dielectric layer of a charging roller for use in electrophotographic apparatuses and to a charging roller for use in electrophotographic apparatuses manufactured using the electroconductive rubber composition.

2. Description of the Related Art

In recent years, there has been increasing use of electrophotographic apparatuses, such as electrophotographic copying machines, printers, and facsimile machines. In general, electrophotographic apparatuses include a photoconductive drum and various electroconductive rollers around the photoconductive drum, such as a charging roller, a developing roller, a transfer roller, and a toner-supply roller.

In reproduction or printing with an electrophotographic apparatus of this type, an electrostatic latent image of an original image is formed on a photoconductive drum. The electrostatic latent image is then coated with toner to form a toner image. The toner image is finally transferred to transfer paper. In order to form the electrostatic latent image, a charging roller is used to electrify the photoconductive drum. Recently, photoconductive drums have often been electrified by contact electrification, in which a charging roller is directly brought into contact with the surface of a photoconductive drum.

An exemplary charging roller includes a shaft, such as an electroconductive shaft, an elastomeric layer (base layer) around the shaft, and if necessary a resistance-adjusting layer (intermediate layer) or a surface protective layer (surface layer) around the base layer. The elastomeric layer (base layer) and the resistance-adjusting layer (intermediate layer) are formed of an electroconductive rubber composition.

In order to efficiently and uniformly transfer electric charges to toner and the photoconductive drum, the rubber composition for use in the elastomeric layer (base layer) or the resistance-adjusting layer (intermediate layer) should have low electrical resistance and electrical uniformity. Since electrophotographic apparatuses of this type can be used at various temperatures and humidity, the electrophotographic apparatuses should be electrically stable against any environmental change.

Ion carriers that can be dispersed in a rubber composition at the molecular level are effective to achieve electrical uniformity of the rubber composition. Examples of such ion carriers include ionic liquids, quaternary ammonium salts, and phosphonium salts.

Japanese Patent No. 4,392,745 discloses a rubber composition containing an imidazolium or pyridinium ionic liquid as an ion carrier. Japanese Unexamined Patent Application Publication No. 2002-132,020 discloses an electroconductive roller that includes an elastic layer around an electroconductive shaft, wherein the elastic layer is formed of a rubber composition containing a quaternary ammonium salt as an ion carrier. Japanese Unexamined Patent Application Publication No. 2001-279,104 discloses an elastic composition containing a tetraethylphosphonium salt, a triethylbenzylphosphonium salt, or a tetramethylphosphonium salt as an ion carrier.

As described in Japanese Patent No. 4,392,745 and Japanese Unexamined Patent Application Publication No. 2002-132,020, however, it was found that an imidazolium, pyridinium, or ammonium ion carrier bled on the surface of a charging roller in an electricity breakdown test. The ion carriers bleeding on the charging roller may pollute a photoconductive drum in contact with the charging roller and lower the image quality.

It was also found that a phosphonium salt described in Japanese Unexamined Patent Application Publication No. 2001-279,104 used as an ion carrier could not sufficiently reduce the electrical resistance of the rubber composition and could not achieve low electrical resistance required for the charging roller. It was also found that there was a large difference between the electrical resistances before and after the electricity breakdown test of the charging roller.

SUMMARY OF THE INVENTION

An electroconductive rubber composition is provided for electrophotographic apparatuses that has low volume resistivity and, when used in a charging roller, does not cause a significant increase in volume resistivity and noticeable blooming of an ion carrier in an electricity breakdown test. A charging roller for use in electrophotographic apparatuses is also provided, wherein the electroconductive rubber composition described above is used to lower the initial volume resistivity and reduce an increase in volume resistivity and the blooming of an ion carrier in an electricity breakdown test.

The reason for the bleeding of an imidazolium, pyridinium, or ammonium ion carrier in the electricity breakdown test is that these ion carriers include a cation having a nitrogen atom as the central atom, and the nitrogen atom coordinates to a polar group of rubber. When an electric current is applied, the cation moves toward an electrode through the rubber composition to be concentrated in the vicinity of the electrode. Unlike the nitrogen atom, a phosphorus atom can coordinate to an unsaturated group, as well as a polar group, and it is therefore effective to use an ion carrier including a cation having a phosphorus atom as the central atom to prevent bleeding in an electricity breakdown test, and also finding a molecular structure effective to achieve low electrical resistance.

An electroconductive rubber composition for electrophotographic apparatuses contains (a) a polar rubber having an unsaturated bond or an ether bond, (b) an ion carrier containing one or more phosphonium salts selected from the group consisting of phosphonium salts having the formulae (1) and (2), and (c) a cross-linker, wherein the amount of (b) component ranges from 0.1 to 10 parts by mass per 100 parts by mass of the (a) component.

$$[(H_9C_4)_3(C_nH_{2n+1})P]^+.(CF_3SO_2)_2N^- \quad (1)$$

(wherein n is an integer in the range of 8 to 16)

$$[(H_9C_4)_3(C_nH_{2n+1})P]^+.(CF_3SO_3)^- \quad (2)$$

(wherein n is an integer in the range of 8 to 16)

A charging roller for use in electrophotographic apparatuses includes a dielectric layer formed of a cross-linked form of the electroconductive rubber composition.

Preferably, the dielectric layer has a thickness in the range of 0.1 to 10 mm.

An electroconductive rubber composition for electrophotographic apparatuses contains particular amounts of (a)

polar rubber having an unsaturated bond or an ether bond, (b) an ion carrier containing a phosphonium salt having a particular molecular structure, and (c) a cross-linker. The electroconductive rubber composition has low volume resistivity and, when used in a charging roller, does not cause a significant increase in volume resistivity and noticeable blooming of the ion carrier in an electricity breakdown test.

In a charging roller for use in electrophotographic apparatuses, the dielectric layer is formed of a cross-linked form of the electroconductive rubber composition. This can lower the initial volume resistivity and reduce an increase in volume resistivity and the blooming of an ion carrier in an electricity breakdown test.

At a thickness of the dielectric layer in the range of 0.1 to 10 mm, variations in electrical resistance resulting from environmental changes can be reduce while an increase in volume resistivity is effectively reduced in the electricity breakdown test. Thus, electrophotographic apparatuses including such a charging roller are electrically stable against any environmental change.

DESCRIPTION OF THE PREFERRED EMBODIMENTS

Figure 1:
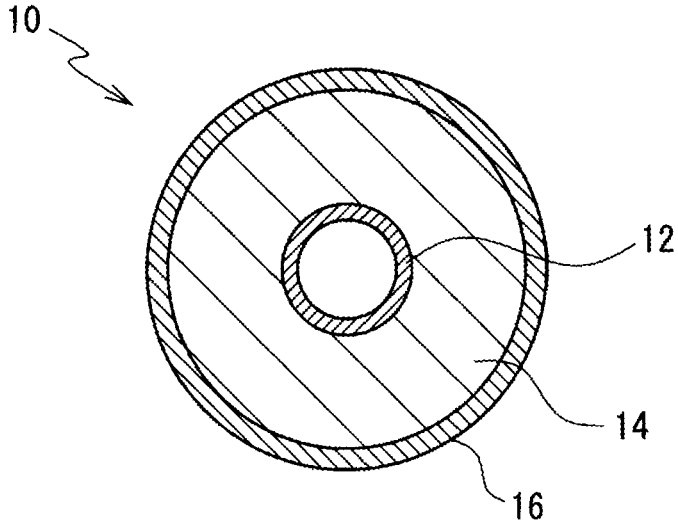
FIG. 1 is a circumferential cross-sectional view of a charging roller for use in electrophotographic apparatuses according to an embodiment.

An electroconductive rubber composition for electrophotographic apparatuses according to the present invention (hereinafter also referred to as the present composition) will be described in detail below.

The present composition contains (a) a polar rubber, (b) a ion carrier, and (c) a cross-linker.

The (a) polar rubber has an unsaturated bond or an ether bond. Polar rubbers are rubbers having a polar group. Examples of the polar group include a chloro group, a nitrile group, a carboxy group, and an epoxy group. Specific examples of the (a) polar rubber include a hydrin rubber, a nitrile rubber (NBR), a urethane rubber (U), an acrylic rubber (a copolymer of acrylate and 2-chloroethyl vinyl ether, ACM), a chloroprene rubber (CR), and an epoxidized natural rubber (ENR).

The (a) polar rubber is preferably a hydrin rubber or a nitrile rubber (NBR) because the present composition can have much lower volume resistivity.

Examples of the hydrin rubber include an epichlorohydrin homopolymer (CO), an epichlorohydrin-ethylene oxide copolymer (ECO), an epichlorohydrin-allyl glycidyl ether copolymer (GCO), and an epichlorohydrin-ethylene oxide-allyl glycidyl ether terpolymer (GECO).

One example of the urethane rubber is a polyether urethane rubber having an ether bond. A polyether urethane rubber can be produced by the reaction between a polyether having hydroxy groups at both ends and a diisocyanate. Examples of the polyether include, but are not limited to, poly(ethylene glycol) and poly(propylene glycol). Examples of the diisocyanate include, but are not limited to, tolylene diisocyanate and diphenylmethane diisocyanate.

The (b) ion carrier contains one or more phosphonium salts selected from the group consisting of phosphonium salts having the formulae (1) and (2).

$$[(H_9C_4)_3(C_nH_{2n+1})P]^+.(CF_3SO_2)_2N^- \quad (1)$$

(wherein n is an integer in the range of 8 to 16)

$$[(H_9C_4)_3(C_nH_{2n+1})P]^+.(CF_3SO_3)^- \quad (2)$$

(wherein n is an integer in the range of 8 to 16)

One example of the alkyl group in the formula (1) or (2) is a linear or branched alkyl group. A linear alkyl group is preferred.

The cation of the (b) ion carrier has a phosphorus atom as the central atom. A phosphorus atom can coordinate to not only a polar group but also an unsaturated group or an ether group. Thus, it is assumed that the phosphorus atom of the cation can coordinate to not only a polar group but also an unsaturated bond or an ether bond of the (a) polar rubber, thereby preventing the cation from moving in the polar rubber. This probably prevents the cation from moving in the polar rubber to be concentrated in the vicinity of an electrode in the electricity breakdown test, thereby efficiently preventing the (b) ion carrier from bleeding out.

In the cation of the (b) ion carrier, four alkyl groups bonded to the phosphorus atom are not the same. The phosphonium cation has an asymmetric structure in which one of the alkyl groups is different from the other three alkyl groups (butyl groups). Thus, it is assumed that the phosphonium salt has lower crystallinity than phosphonium salts having a symmetric structure. The phosphonium salt therefore probably easily dissociates into ions in the polar rubber, contributing to the low electrical resistance of the present composition.

In the cation of the (b) ion carrier, the number of carbon atoms of one alkyl group bonded to the phosphorus atom is an integer in the range of 8 to 16, and the number of carbon atoms of the other three alkyl group is 4. With the cation having carbon atoms in this range, the present composition can have low resistance (low volume resistivity) and, when used in a charging roller, does not cause a significant increase in volume resistivity after the electricity breakdown test. The number of carbon atoms of one alkyl group less than eight results in an increase in the volume resistivity of the charging roller after the electricity breakdown test. The number of carbon atoms of one alkyl group more than 16 results in high volume resistivity of the present composition and an increase in the volume resistivity of the charging roller after the electricity breakdown test.

The anions $(CF_3SO_2)_2N^-$ (hereinafter abbreviated as TFSI) and $CF_3SO_3^-$ (hereinafter abbreviated as TF) of the (b) ion carrier have low basicity because of many fluorine groups in the structure and consequently form a relatively weak ionic bond with a cation. These phosphonium salts therefore easily dissociate into ions in the polar rubber, probably contributing to the low electrical resistance of the polar rubber.

The anions TFSI and TF of the (b) ion carrier are hydrophobic and, even in a high humidity environment, less hygroscopic. This will more efficiently reduce variations in electrical resistance resulting from environmental changes. Among these two anions, TFSI is more hydrophobic and can more efficiently prevent variations in electrical resistance resulting from environmental changes.

The amount of (b) ion carrier ranges from 0.1 to 10 parts by mass per 100 parts by mass of the (a) polar rubber. Less than 0.1 parts by mass of the (b) ion carrier results in no appreciable effect of reducing the volume resistivity of the present composition. This also results in an increase in the volume resistivity of the charging roller after the electricity breakdown test. More than 10 parts by mass of the (b) ion carrier results in the bleeding of the ion carrier from the charging roller after the electricity breakdown test.

The amount of (b) ion carrier preferably ranges from 0.5 to 7 parts by mass, more preferably 1 to 5 parts by mass, per 100 parts by mass of the (a) polar rubber. These ranges result in an excellent balance between the effect of reducing the volume resistivity of the present composition and the effect of reducing the bleeding of the ion carrier after the electricity breakdown test.

The phosphonium salts having the formula (1) can be produced by the anion-exchange reaction of a phosphonium halide having a corresponding phosphonium cation with bis (trifluoromethanesulfonyl)imidic acid or an alkali metal salt thereof. The phosphonium halide may be a commercially available phosphonium halide or may be produced by reacting tributylphosphine with an alkyl halide having 8 to 16 carbon atoms. The phosphonium salts having the formula (2) can be produced in a similar manner.

The (c) cross-linker may be any cross-linker that can cross-link the (a) polar rubber. Examples of the (c) cross-linker include sulfur cross-linkers, peroxide cross-linkers, and dechlorination cross-linkers. These cross-linkers may be used alone or in combination.

Examples of the sulfur cross-linkers include known sulfur cross-linkers, such as powdered sulfur, precipitated sulfur, colloid sulfur, surface-treated sulfur, insoluble sulfur, sulfur chlorides, thiuram vulcanization accelerators, and polymer polysulfides.

Examples of the peroxide cross-linkers include known peroxide cross-linkers, such as peroxyketals, dialkyl peroxides, peroxyesters, ketone peroxides, peroxydicarbonates, diacylperoxides, and hydroperoxides.

Examples of the dechlorination cross-linkers include dithiocarbonate compounds, such as quinoxaline-2,3-dithiocarbonate, 6-methylquinoxaline-2,3-dithiocarbonate, 6-isopropylquinoxaline-2,3-dithiocarbonate, and 5,8-dimethylquinoxaline-2,3-dithiocarbonate.

In order to prevent bleeding, the amount of (c) cross-linker preferably ranges from 0.1 to 2 parts by mass, more preferably 0.3 to 1.8 parts by mass, still more preferably 0.5 to 1.5 parts by mass, per 100 parts by mass of the (a) polar rubber.

Use of a dechlorination cross-linker as the (c) cross-linker may be combined with the use of a dechlorination cross-linking accelerator. Examples of the dechlorination cross-linking accelerator include 1,8-diazabicyclo(5,4,0)undecene-7 (hereinafter abbreviated as DBU) and weak acid salts thereof. Weak acid salts of DBU are preferred in terms of handling. Examples of the weak acid salts of DBU include carbonates, stearates, 2-ethylhexyl acid salts, benzoates, salicylates, 3-hydroxy-2-naphthoic acid salts, phenolic resin salts, 2-mercaptobenzothiazole salts, and 2-mercaptobenzimidazole salts.

In order to prevent bleeding, the amount of dechlorination cross-linking accelerator preferably ranges from 0.1 to 2 parts by mass, more preferably 0.3 to 1.8 parts by mass, still more preferably 0.5 to 1.5 parts by mass, per 100 parts by mass of the (a) polar rubber.

The present composition may contain one or more additive agents, including an electroconductive agent, such as carbon black, a lubricant, an age resister, a light stabilizer, a viscosity modifier, a processing aid, a flame retardant, a plasticizer, a blowing agent, a filler, a dispersant, an antifoaming agent, a pigment, and a mold-release agent.

The present composition is suitable for an electroconductive rubber composition for a charging roller for use in electrophotographic apparatuses. More specifically, the present composition is suitable for an electroconductive rubber composition to form a base layer or a dielectric layer, such as a resistance-adjusting layer, of the charging roller. In addition to the charging roller for use in electrophotographic apparatuses, the present composition can be used as a material for an elastic layer of a developing roller, a transfer roller, a transfer belt, or a toner-supply roller, which is an electroconductive component for use in electrophotographic apparatuses.

As described above, the present composition contains the (a) polar rubber and the (b) ion carrier. Use of the present composition to form a base layer or a dielectric layer, such as a resistance-adjusting layer, of the charging roller can lower the volume resistivity and reduce an increase in volume resistivity and the blooming of an ion carrier in the electricity breakdown test. The present composition can also reduce variations in electrical resistance resulting from environmental changes.

With a decrease in volume resistivity, the target resistance can be achieved using a smaller amount of ion carrier. This can reduce the blooming of the ion carrier. Reduction of an increase in volume resistivity in the electricity breakdown test allows the charging roller to be used for a longer period of time. Reduction of the blooming of an ion carrier in the electricity breakdown test allows the charging roller to be used for a longer period of time and allows reduction of the thickness of the base layer or the resistance-adjusting layer of the charging roller, thereby reducing the diameter of the charging roller. Reduction of the blooming of an ion carrier in the electricity breakdown test can also prevent the separation of the base layer from the shaft or the resistance-adjusting layer.

A charging roller for use in electrophotographic apparatuses according to the present invention will be described below.

Figure 2:
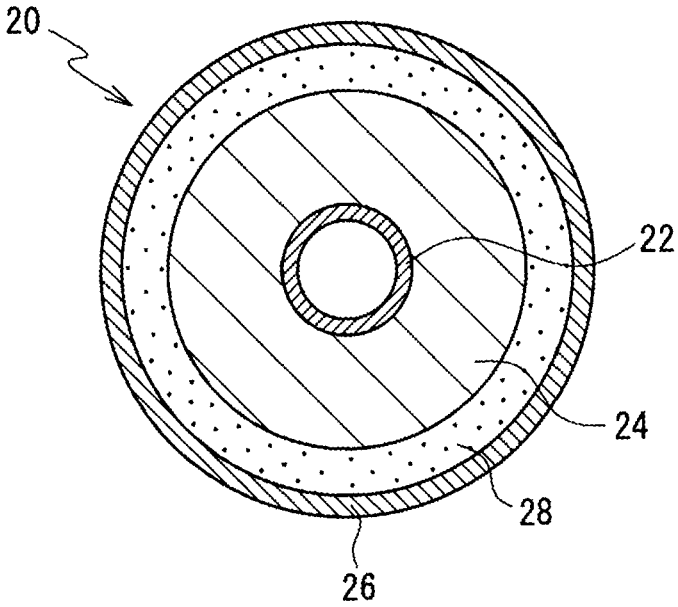
FIG. 2 is a circumferential cross-sectional view of a charging roller for use in electrophotographic apparatuses according to another embodiment.

FIGS. 1 and 2 illustrate charging rollers for use in electrophotographic apparatuses according to embodiments of the present invention. FIGS. 1 and 2 are circumferential cross-sectional views of charging rollers for use in electrophotographic apparatuses.

Referring to FIG. 1, a charging roller 10 includes a base layer 14 and a surface layer 16 layered in this order on a shaft 12. Since the charging roller 10 includes no resistance-adjusting layer on the base layer 14, the base layer 14 functions as a dielectric layer. Thus, the present composition is used as a material for the base layer 14.

Referring to FIG. 2, a charging roller 20 includes a base layer 24, a resistance-adjusting layer 28, and a surface layer 26 layered in this order on a shaft 22. The resistance-adjusting layer 28 functions as a dielectric layer. Thus, the present composition is used as a material for the resistance-adjusting layer 28.

The structure of the charging roller is not limited to those illustrated in FIGS. 1 and 2. For example, in addition to the resistance-adjusting layer 28, one or more intermediate layers may be disposed between the base layer and the surface layer. Alternatively, instead of providing the surface layer, the surface of the base layer or an intermediate layer, such as the resistance-adjusting layer, may be modified to have the surface properties of the surface layer. The surface modification may be performed by UV or electron beam irradiation or by making an unsaturated bond or halogen of the base layer contact with a surface modifier, for example, a compound having a reactive group, such as an isocyanate group, a hydrosilyl group, an amino group, a halogen group, or a thiol group.

In the charging roller 10 illustrated in FIG. 1, the base layer 14 can be formed by coaxially placing the shaft 12 in a hollow portion of a roll forming die, injecting, heating, and hardening the present composition, and removing the shaft 12 (an injection method) or by extruding the present composition on the surface of the shaft 12 (an extrusion method).

The thickness of the base layer 14 preferably ranges from 0.1 to 10 mm. This range results in reduction of variations (an increase) in volume resistivity resulting from the electricity breakdown test and reduction of variations in electrical resistance resulting from environmental changes. The thickness of the base layer 14 less than 0.1 mm tends to result in increased variations in volume resistivity resulting from the electricity breakdown test. The thickness of the base layer 14 more than 10 mm tends to result in increased variations in electrical resistance resulting from environmental changes.

The thickness of the base layer 14 more preferably ranges from 0.5 to 5 mm, still more preferably 1 to 3 mm. These more preferred and still more preferred ranges of the thickness of the base layer 14 can result in a better balance between the effect of reducing variations in volume resistivity resulting from the electricity breakdown test and the effect of reducing variations in electrical resistance resulting from environmental changes.

The base layer 14 preferably has a volume resistivity in the range of $10^2$ to $10^{10}$ Ωcm, more preferably $10^3$ to $10^9$ Ωcm, still more preferably $10^4$ to $10^8$ Ωcm. The base layer 14 formed of the present composition can have a volume resistivity in these ranges.

The shaft 12 may be any electroconductive shaft. More specifically, the shaft 12 may be a metal core of a solid or hollow member made of iron, stainless, or aluminum. The shaft 12 may be coated with an adhesive or a primer. The adhesive or the primer may be rendered electrically conductive.

The surface layer 16 can function as a protective layer of the roller surface. The surface layer 16 may be essentially composed of a polyamide (nylon), acrylic, urethane, silicone, or fluorinated polymer. These polymers may be modified. Examples of the modifying group include an N-methoxymethyl group, a silicone group, and a fluorine group.

In order to impart electrical conductivity, the surface layer 16 may contain a known electroconductive agent, such as carbon black, graphite, c-$TiO_2$, c-ZnO, or c-$SnO_2$ (c-means electrically conductive), or an ion carrier (a quaternary ammonium salt, a borate, or a surfactant). The surface layer 16 may contain various additive agents.

The surface layer 16 is formed of a surface-layer-forming composition. The surface-layer-forming composition contains the main material and the electroconductive agent described above and optionally other additive agents. Examples of the additive agents include lubricants, vulcanization accelerators, age resisters, light stabilizers, viscosity modifiers, processing aids, flame retardants, plasticizers, blowing agents, fillers, dispersants, antifoaming agents, pigments, and mold-release agents.

In order to control viscosity, the surface-layer-forming composition may contain an organic solvent, such as methyl ethyl ketone, toluene, acetone, ethyl acetate, butyl acetate, methyl isobutyl ketone (MIBK), THF, or DMF, or a water-soluble solvent, such as methanol or ethanol.

The surface layer 16 may be formed by applying the surface-layer-forming composition to the base layer 14 by roll coating, dipping, or spray coating. The surface layer 16 thus coated may be subjected to ultraviolet irradiation or heat treatment.

The thickness of the surface layer 16 is preferably, but not necessarily, in the range of 0.01 to 100 μm, more preferably 0.1 to 20 μm, still more preferably 0.3 to 10 μm. The surface layer 16 preferably has a volume resistivity in the range of $10^4$ to $10^9$ Ωcm, more preferably $10^5$ to $10^8$ Ωcm, still more preferably $10^6$ to $10^7$ Ωcm.

In the charging roller 20 illustrated in FIG. 2, examples of the main material of the base layer 24 include various rubber materials, such as an ethylene-propylene rubber (EPDM), a nitrile rubber (NBR), a styrene-butadiene rubber (SBR), a silicone rubber, a butadiene rubber (BR), an isoprene rubber (IR), an acrylic rubber (ACM), a chloroprene rubber (CR), a urethane rubber (U), a fluorocarbon rubber, a hydrin rubber (CO, ECO, GCO, and GECO), a natural rubber (NR), and an epoxidized natural rubber (ENR). These materials may be used alone or in combination.

In order to impart electrical conductivity, the base layer 24 may contain a known electroconductive agent, such as carbon black, graphite, c-$TiO_2$, c-ZnO, or c-$SnO_2$ (c-means electrically conductive), or an ion carrier (a quaternary ammonium salt, a borate, or a surfactant). The electroconductive agent can impart electrical conductivity of a volume resistivity in the range of $5\times10^2$ to $1\times10^5$ Ωcm.

The base layer 24 may contain various additive agents. Examples of the additive agents include extenders, reinforcing agents, processing aids, curing agents, cross-linkers, cross-linking accelerators, blowing agents, antioxidants, plasticizers, ultraviolet absorbers, silicone oils, lubricants, aids, and surfactants.

The base layer 24 illustrated in FIG. 2 can be formed in a manner similar to the base layer 14 illustrated in FIG. 1. The base layer 24 preferably has a thickness in the range of 0.1 to 10 mm, more preferably 0.5 to 5 mm, still more preferably 1 to 3 mm.

The resistance-adjusting layer 28 can be formed by coaxially placing the shaft 22, on which the base layer 24 has been formed, in a hollow portion of a roll forming die, injecting, heating, and hardening the present composition, and removing the shaft 22 (an injection method) or by extruding the present composition on the surface of the base layer 24 (an extrusion method).

The resistance-adjusting layer 28 preferably has a thickness in the range of 0.1 to 10 mm. This range results in reduced variations in volume resistivity resulting from the electricity breakdown test and reduced variations in electrical resistance resulting from environmental changes. The thickness of the resistance-adjusting layer 28 less than 0.1 mm tends to result in increased variations in volume resistivity resulting from the electricity breakdown test. The thickness of the resistance-adjusting layer 28 more than 10 mm tends to result in increased variations in electrical resistance resulting from environmental changes.

The resistance-adjusting layer 28 more preferably has a thickness in the range of 0.5 to 5 mm, still more preferably 1 to 3 mm. These more preferred and still more preferred ranges of the thickness of the resistance-adjusting layer 28 can result in a better balance between the effect of reducing variations in volume resistivity resulting from the electricity breakdown test and the effect of reducing variations in electrical resistance resulting from environmental changes.

The resistance-adjusting layer 28 preferably has a volume resistivity in the range of $10^2$ to $10^{10}$ Ωcm, more preferably $10^3$ to $10^9$ Ωcm, still more preferably $10^4$ to $10^8$ Ωcm. The resistance-adjusting layer 28 formed of the present composition can have a volume resistivity in these ranges.

The structure of the shaft 22 and the surface layer 26 of the charging roller 20 illustrated in FIG. 2 may be the same as the structure of the shaft 12 and the surface layer 16 of the charging roller 10 illustrated in FIG. 1. The surface layer 26 may be formed on the resistance-adjusting layer 28 by applying a surface-layer-forming composition to the resistance-adjusting layer 28.

The charging rollers having these structures are suitably used while being pressed against a photoconductive drum under a constant load, that is, as the charging rollers in a contact electrification mode.

EXAMPLES

The present invention will be further described in the following examples. Although charging rollers having a base layer and a surface layer layered in this order on a shaft are described in the examples, the present invention is not limited to these charging rollers.

Example 1

Synthesis of Phosphonium Salts

Tri-n-butyldodecylphosphonium bromide and bis(trifluoromethanesulfonyl)imidic acid were stirred in a mixture of methylene chloride and ion-exchanged water (1:1) at room temperature for four hours. Tri-n-butyldodecylphosphonium bis(trifluoromethanesulfonyl)imide was obtained from an organic layer. The cationic species of this phosphonium salt is abbreviated as "$(C_4)_3(C_{12})P$". The anionic species of this phosphonium salt is abbreviated as "TFSI".

Preparation of Electroconductive Rubber Composition

Three parts by mass of the phosphonium salt and 2 parts by mass of sulfur ("Sulfur-PTC" manufactured by Tsurumi Chemical Industry Co., Ltd.) as a cross-linker were added to 100 parts by mass of a hydrin rubber (ECO, "Hydrin T3106" manufactured by ZEON Corp.). This mixture was stirred with a stirrer to prepare an electroconductive rubber composition according to Example 1.

Fabrication of Charging Roller

Formation of Base Layer

A metal core (diameter 6 mm) was placed in a forming die. The electroconductive rubber composition described above was injected into the forming die, was heated at 170° C. for 30 minutes, was cooled, was removed from the forming die, forming a base layer (dielectric layer) having a thickness of 1.5 mm on the metal core.

Formation of Surface Layer

A hundred parts by mass of N-methoxymethylated nylon ("EF30T" manufactured by Nagase ChemteX Corp.), 60 parts by mass of electroconductive tin oxide ("S-2000" manufactured by Mitsubishi Materials Corp.), 1 part by mass of citric acid, and 300 parts by mass of methanol were mixed to prepare a surface-layer-forming composition. The surface-layer-forming composition was applied to the base layer by roll coating and was heated at 120° C. for 50 minutes to form a surface layer having a thickness of 10 μm. Thus, a charging roller according to Example 1 was fabricated.

Examples 2 and 3 and Comparative Examples 10 and 11

Electroconductive rubber compositions were prepared in the same manner as in Example 1 except that the amount of phosphonium salt was altered as shown in Table 1 or 4. Charging rollers were fabricated in the same manner as in Example 1 using the electroconductive rubber compositions thus prepared.

Examples 4 to 6

An electroconductive rubber composition was prepared in the same manner as in Example 1. A charging roller was fabricated in the same manner as in Example 1 except that the electroconductive rubber composition thus prepared was used and that the base layer having a thickness of 0.1, 10, or 11 mm was formed.

Examples 7 to 11

Electroconductive rubber compositions were prepared in the same manner as in Example 1 except that the hydrin rubber was replaced with each of the polar rubbers listed in Table 1. Charging rollers were fabricated in the same manner as in Example 1 using the electroconductive rubber compositions thus prepared. The polar rubbers used are described in detail below.

Nitrile rubber (NBR): "Nipol DN302" manufactured by ZEON Corp.

Urethane rubber (U): "Millathane E-34" manufactured by TSE Industries, Inc.

Acrylic rubber (ACM): "Nipol AR31" manufactured by ZEON Corp.

Chloroprene rubber (CR): "SKYPRENE B-30" manufactured by Tosoh Corp.

Epoxidized natural rubber (ENR): "EPDXYPRENE 50" manufactured by MMG

Example 12

Tri-n-butyldodecylphosphonium trifluoromethanesulfonate was prepared in the same manner as in Example 1 except that bis(trifluoromethanesulfonyl)imidic acid was replaced with lithium trifluoromethanesulfonate in the synthesis of the phosphonium salt. The cationic species of this phosphonium salt is abbreviated as "$(C_4)_3(C_{12})P$". The anionic species of this phosphonium salt is abbreviated as "TF". An electroconductive rubber composition was then prepared in the same manner as in Example 1 except that the phosphonium salt thus prepared was substituted for the phosphonium salt in Example 1. A charging roller was fabricated in the same manner as in Example 1 using the electroconductive rubber composition thus prepared.

Examples 13 and 14 and Comparative Examples 12 and 13

Electroconductive rubber compositions were prepared in the same manner as in Example 2 except that the amount of phosphonium salt was altered as shown in Table 2 or 4. Charging rollers were fabricated in the same manner as in Example 2 using the electroconductive rubber compositions thus prepared.

Examples 15 to 19

Electroconductive rubber compositions were prepared in the same manner as in Example 2 except that the hydrin rubber was replaced with each of the polar rubbers listed in Table 2. Charging rollers were fabricated in the same manner as in Example 2 using the electroconductive rubber compositions thus prepared.

Examples 20 to 27 and Comparative Examples 8 and 9

Tri-n-butylalkylphosphonium trifluoromethanesulfonates were prepared in the same manner as in Example 1 except that tri-n-butyldodecylphosphonium bromide was replaced with tri-n-butylalkylphosphonium bromide (wherein the alkyl group was one of C7 to C11 and C13 to C17 linear alkyl groups). The cationic species of these phosphonium salts is abbreviated as "$(C_4)_3(C_m)P$", wherein m is an integer in the range of 7 to 11 and 13 to 17. Electroconductive rubber compositions were then prepared in the same manner as in Example 1 except that the phosphonium salts thus prepared were substituted for the phosphonium salt in Example 1. Charging rollers were fabricated in the same manner as in Example 1 using the electroconductive rubber compositions thus prepared.

Comparative Examples 1 to 7

Electroconductive rubber compositions were prepared in the same manner as in Example 1 except that the phosphonium salt in Example 1 was replaced with each of the following phosphonium salts. Charging rollers were fabricated in the same manner as in Example 1 using the electroconductive rubber compositions thus prepared. The following phosphonium salts were commercial products or were synthesized by the method for synthesizing a phosphonium salt described in Example 1.

Phosphonium Salts According to Comparative Examples 1 to 7

1-hexyl-3-methylimidazolium trifluoromethanesulfonate

Tetra-n-butylammonium chloride (abbreviated as $(C_4)_4NCl$)

Tetramethylphosphonium chloride (abbreviated as $(C_1)_4PCl$)

Tetra-n-butylphosphonium bis(trifluoromethanesulfonyl) imide (abbreviated as $(C_4)_4P$-TFSI)

Tetra-n-butylphosphonium chloride (abbreviated as $(C_4)_4PCl$)

Tri-n-butyldodecylphosphonium p-toluenesulfonate (abbreviated as $(C_4)_3(C_{12})P$-PTS)

Tri-n-butyldodecylphosphonium bromide (abbreviated as $(C_4)_3(C_{12})PBr$)

The electroconductive rubber compositions thus prepared were pressed and cross-linked at 180° C. for 20 minutes to form sheet samples having a thickness of 2 mm (the thicknesses in Examples 4 to 6 were 0.1, 10, and 11 mm, respectively). The properties of the material of the sheet samples were determined. The measurement and evaluation methods are described below.

Initial Volume Resistivity

A silver paste was applied to one surface of a sheet sample to form a 10×10 mm electrode (with a guard electrode). A counter electrode was formed on the other surface of the sheet sample. The resistance between the electrodes was measured at an applied voltage of 100 V in accordance with JIS K 6911. The volume resistivity of less than $1\times10^7$ Ωcm was considered as satisfactory.

Variations in Volume Resistivity Resulting from Electricity Breakdown Test

A DC 200 μA constant current was continuously applied for 60 minutes to perform an electricity breakdown test. The volume resistivity after the electricity breakdown test was measured by the method for measuring the initial volume resistivity. The logarithm of a difference between the initial volume resistivity and the volume resistivity measured after the electricity breakdown test was calculated as a variation (a variation resulting from the electricity breakdown test). The variation of less than the order of 0.100 was considered as satisfactory.

Bleeding after Electricity Breakdown Test

A voltage of 1000 V was applied for 600 minutes to a sheet sample between a negative aluminum electrode having a diameter of 40 mm and a positive aluminum metal plate. The interface between the sheet sample and the aluminum electrode was then observed under magnification (with respect to the presence of bleed). The absence and presence of bleed were indicated by "Pass" and "Fail", respectively.

Variations in Volume Resistivity Resulting from Environmental Changes

The volume resistivity was measured at 15° C.×10% RH and 32.5° C.×85% RH by the method for measuring the initial volume resistivity. The logarithm of a difference in volume resistivity between these conditions was calculated as a variation (a variation resulting from environmental changes). The variation of less than the order of 0.50 was considered as satisfactory.

The characteristics of the charging rollers fabricated were determined. The measurement and evaluation methods are described below.

Electrical Resistance

Figure 3:
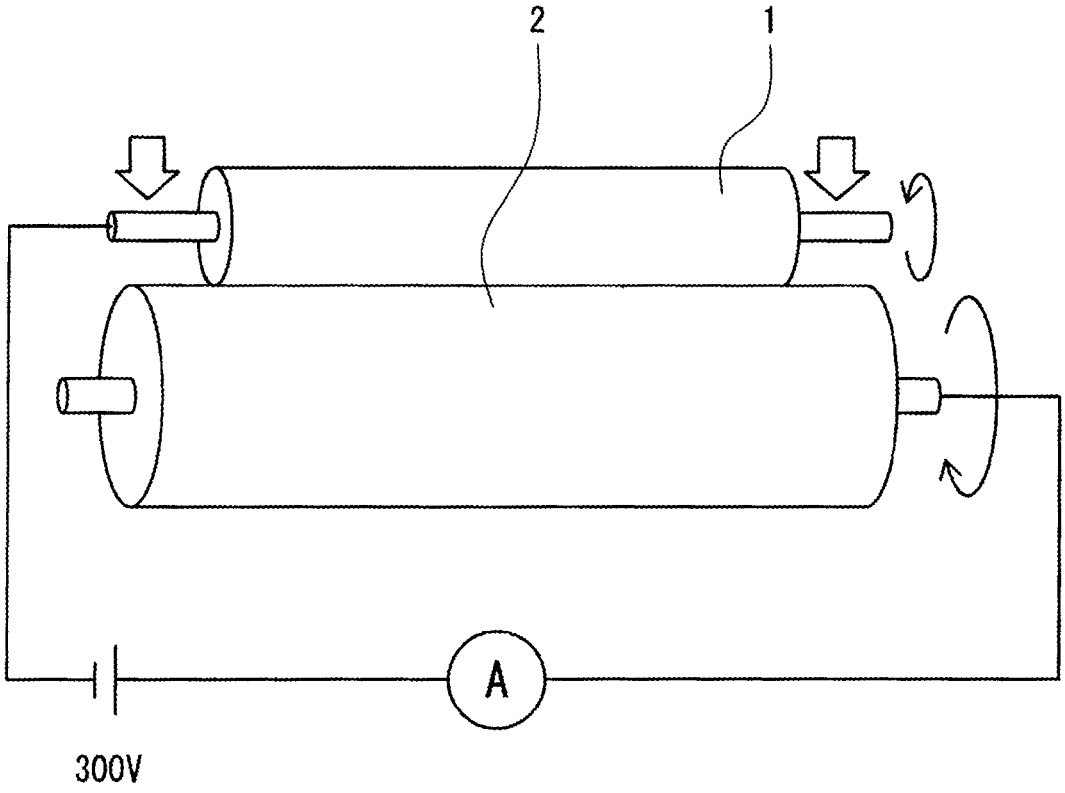
FIG. 3 is a schematic explanatory view of a method for measuring the electrical resistance (roller resistance) of a charging roller in an example.

As illustrated in FIG. 3, a metal roller 2 (diameter: 30 mm) was rotated at a predetermined number of revolutions in the direction of the arrow while a charging roller 1 was pressed against the metal roller 2 under a predetermined load. The charging roller 1 was rotated in association with the rotation of the metal roller 2. While the metal roller 2 and the charging roller 1 were simultaneously rotated, a voltage of 300 V was applied between one end of the charging roller 1 and one end of the metal roller 2. The electric current was measured to determine the electrical resistance (roller resistance (Ω)).

Variations in Volume Resistivity Resulting from Electricity Breakdown Test

The electrical resistance of the charging roller was measured at 15° C.×10% RH before the electricity breakdown test by the method for measuring the electrical resistance. In the same environment, the charging roller was brought into contact with a mirror-finished metal roller (metal drum) having a diameter of 30 mm such that the shafts of these rollers were parallel to each other. While a load of 500 gf was applied to each end of the shaft of the charging roller, the metal drum was rotated at 30 rpm (the charging roller was rotated in association with the rotation of the metal drum). A DC 200 μA constant current was continuously applied for three hours to perform the electricity breakdown test. After the electricity breakdown test, the electrical resistance of the charging roller was measured at 15° C.×10% RH by the method for measuring the electrical resistance. The order of the resistance change was determined from the electrical resistances of the charging roller before and after the electricity breakdown test. The variation of less than the order of 0.100 was considered as satisfactory.

Bleeding After Electricity Breakdown Test

After the electricity breakdown test, the surface of the charging roller was visually inspected (with respect to the presence of bleed). The absence and presence of bleed were indicated by "Pass" and "Fail", respectively.

TABLE 1

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Polar rubber | ECO | | | | | | NBR | U | ACM | CR | ENR |
| Ion carrier | | | | | | | | | | | |
| Cationic species | $(C_4)_3(C_{12})P$ | | | | | | | | | | |
| Anionic species | TFSI | | | | | | | | | | |
| Amount (phr) | 3 | 0.1 | 10 | 3 | 3 | 3 | 3 | 3 | 3 | 3 | 3 |
| Properties of material | | | | | | | | | | | |
| Thickness of sheet (mm) | 2 | 2 | 2 | 0.1 | 10 | 11 | 2 | 2 | 2 | 2 | 2 |
| Initial volume resistivity (Ω · cm) | $2.35 \times 10^6$ | $9.78 \times 10^6$ | $1.40 \times 10^6$ | $9.10 \times 10^5$ | $4.12 \times 10^6$ | $6.68 \times 10^6$ | $4.72 \times 10^6$ | $6.92 \times 10^6$ | $7.24 \times 10^6$ | $7.51 \times 10^6$ | $7.94 \times 10^6$ |
| Variation resulting from electricity breakdown test | 0.078 | 0.098 | 0.068 | 0.098 | 0.054 | 0.048 | 0.045 | 0.035 | 0.047 | 0.041 | 0.059 |
| Bleeding in electricity breakdown test | Pass | Pass | Fair | Pass | Pass | Pass | Pass | Pass | Pass | Pass | Pass |
| Variation resulting from environmental changes | 0.23 | 0.34 | 0.18 | 0.15 | 0.49 | 0.50 | 0.12 | 0.21 | 0.15 | 0.18 | 0.19 |
| Characteristics of charging roller | | | | | | | | | | | |
| Electrical resistance (Ω) | $4.32 \times 10^6$ | $1.26 \times 10^7$ | $2.39 \times 10^6$ | $1.66 \times 10^6$ | $7.46 \times 10^6$ | $1.20 \times 10^7$ | $4.73 \times 10^6$ | $1.20 \times 10^7$ | $8.41 \times 10^6$ | $1.11 \times 10^7$ | $1.30 \times 10^7$ |
| Variation resulting from electricity breakdown test | 0.071 | 0.090 | 0.068 | 0.097 | 0.054 | 0.047 | 0.048 | 0.034 | 0.043 | 0.037 | 0.057 |
| Bleeding in electricity breakdown test | Pass | Pass | Fair | Pass | Pass | Pass | Pass | Pass | Pass | Pass | Pass |

TABLE 2

| | Example | | | | | | | |
|---|---|---|---|---|---|---|---|---|
| | 12 | 13 | 14 | 15 | 16 | 17 | 18 | 19 |
| Polar rubber | ECO | | | NBR | U | ACM | CR | ENR |
| Ion carrier | | | | | | | | |
| Cationic species | $(C_4)_3(C_{12})P$ | | | | | | | |
| Anionic species | TF | | | | | | | |
| Amount (phr) | 3 | 0.1 | 10 | 3 | 3 | 3 | 3 | 3 |
| Properties of material | | | | | | | | |
| Thickness of sheet (mm) | 2 | 2 | 2 | 2 | 2 | 2 | 2 | 2 |
| Initial volume resistivity (Ω · cm) | $4.02 \times 10^6$ | $9.80 \times 10^6$ | $4.20 \times 10^6$ | $5.79 \times 10^6$ | $7.45 \times 10^6$ | $8.43 \times 10^6$ | $8.84 \times 10^6$ | $8.91 \times 10^6$ |
| Variation resulting from electricity breakdown test | 0.079 | 0.088 | 0.056 | 0.040 | 0.031 | 0.041 | 0.034 | 0.050 |
| Bleeding in electricity breakdown test | Pass | Pass | Fair | Pass | Pass | Pass | Pass | Pass |
| Variation resulting from environmental changes | 0.28 | 0.37 | 0.21 | 0.14 | 0.25 | 0.19 | 0.21 | 0.23 |
| Characteristics of charging roller | | | | | | | | |
| Electrical resistance (Ω) | $6.95 \times 10^6$ | $1.84 \times 10^7$ | $7.62 \times 10^6$ | $6.80 \times 10^6$ | $1.25 \times 10^7$ | $1.40 \times 10^7$ | $9.20 \times 10^6$ | $9.03 \times 10^6$ |
| Variation resulting from electricity breakdown test | 0.075 | 0.087 | 0.051 | 0.042 | 0.029 | 0.045 | 0.037 | 0.054 |
| Bleeding in electricity breakdown test | Pass | Pass | Fair | Pass | Pass | Pass | Pass | Pass |

TABLE 3

| | Example | | | | | | | |
|---|---|---|---|---|---|---|---|---|
| | 20 | 21 | 22 | 23 | 24 | 25 | 26 | 27 |
| Polar rubber | ECO | | | | | | | |
| Ion carrier | | | | | | | | |
| Cationic species | $(C_4)_3(C_8)P$ | $(C_4)_3(C_9)P$ | $(C_4)_3(C_{10})P$ | $(C_4)_3(C_{11})P$ | $(C_4)_3(C_{13})P$ | $(C_4)_3(C_{14})P$ | $(C_4)_3(C_{15})P$ | $(C_4)_3(C_{16})P$ |
| Anionic species | TFSI | | | | | | | |
| Amount (phr) | 3 | 3 | 3 | 3 | 3 | 3 | 3 | 3 |
| Properties of material | | | | | | | | |
| Thickness of sheet (mm) | 2 | 2 | 2 | 2 | 2 | 2 | 2 | 2 |
| Initial volume resistivity (Ω · cm) | $3.56 \times 10^6$ | $3.21 \times 10^6$ | $3.11 \times 10^6$ | $2.89 \times 10^6$ | $2.60 \times 10^6$ | $4.34 \times 10^6$ | $5.10 \times 10^6$ | $7.90 \times 10^6$ |
| Variation resulting from electricity breakdown test | 0.096 | 0.096 | 0.095 | 0.095 | 0.090 | 0.085 | 0.094 | 0.095 |
| Bleeding in electricity breakdown test | Pass | Pass | Pass | Pass | Pass | Pass | Pass | Pass |
| Variation resulting from environmental changes | 0.25 | 0.25 | 0.24 | 0.24 | 0.23 | 0.22 | 0.22 | 0.21 |
| Characteristics of charging roller | | | | | | | | |
| Electrical resistance (Ω) | $4.87 \times 10^6$ | $4.85 \times 10^6$ | $4.53 \times 10^6$ | $3.21 \times 10^6$ | $2.66 \times 10^6$ | $6.30 \times 10^6$ | $6.81 \times 10^6$ | $1.40 \times 10^7$ |
| Variation resulting from electricity breakdown test | 0.092 | 0.090 | 0.091 | 0.087 | 0.085 | 0.085 | 0.086 | 0.090 |
| Bleeding in electricity breakdown test | Pass | Pass | Pass | Pass | Pass | Pass | Pass | Pass |

TABLE 4

| | Comparative example | | | | | | |
|---|---|---|---|---|---|---|---|
| | 1 | 2 | 3 | 4 | 5 | 6 | 7 |
| Polar rubber | ECO | | | | | | |
| Ion carrier | | | | | | | |
| Cationic species | *1 | $(C_4)_4N$ | $(C_1)_4P$ | $(C_4)_4P$ | $(C_4)_4P$ | $(C_4)_3(C_{12})P$ | |
| Anionic species | TF | Cl | Cl | TFSI | Cl | PTS | Br |
| Amount (phr) | 3 | 3 | 3 | 3 | 3 | 3 | 3 |
| Properties of material | | | | | | | |
| Thickness of sheet (mm) | 2 | 2 | 2 | 2 | 2 | 2 | 2 |
| Initial volume resistivity (Ω · cm) | $3.50 \times 10^6$ | $2.15 \times 10^8$ | $1.57 \times 10^8$ | $9.45 \times 10^6$ | $3.57 \times 10^8$ | $5.21 \times 10^7$ | $2.82 \times 10^8$ |
| Variation resulting from electricity breakdown test | 0.077 | 0.185 | 0.387 | 0.185 | 0.247 | 0.086 | 0.230 |
| Bleeding in electricity breakdown test | Fail | Fail | Pass | Pass | Pass | Pass | Pass |
| Variation resulting from environmental changes | 0.29 | 0.49 | 0.51 | 0.48 | 0.54 | 0.35 | 0.64 |
| Characteristics of charging roller | | | | | | | |
| Electrical resistance (Ω) | $3.57 \times 10^6$ | $3.64 \times 10^8$ | $2.43 \times 10^8$ | $1.26 \times 10^7$ | $5.74 \times 10^8$ | $6.69 \times 10^7$ | $4.14 \times 10^8$ |
| Variation resulting from electricity breakdown test | 0.076 | 0.175 | 0.353 | 0.168 | 0.222 | 0.084 | 0.215 |
| Bleeding in electricity breakdown test | Fail | Fail | Pass | Pass | Pass | Pass | Pass |

| | Comparative example | | | | | |
|---|---|---|---|---|---|---|
| | 8 | 9 | 10 | 11 | 12 | 13 |
| Polar rubber | ECO | | | | | |
| Ion carrier | | | | | | |
| Cationic species | $(C_4)_3(C_7)P$ | $(C_4)_3(C_{17})P$ | $(C_4)_3(C_{12})P$ | | | |
| Anionic species | TFSI | TFSI | TFSI | | TF | |
| Amount (phr) | 3 | 3 | 0.05 | 11 | 0.05 | 11 |
| Properties of material | | | | | | |
| Thickness of sheet (mm) | 2 | 2 | 2 | 2 | 2 | 2 |
| Initial volume resistivity (Ω · cm) | $6.56 \times 10^6$ | $1.47 \times 10^7$ | $2.30 \times 10^7$ | $1.10 \times 10^6$ | $4.34 \times 10^7$ | $3.90 \times 10^6$ |
| Variation resulting from electricity breakdown test | 0.180 | 0.130 | 0.150 | 0.061 | 0.143 | 0.050 |
| Bleeding in electricity breakdown test | Pass | Pass | Pass | Fail | Pass | Fail |
| Variation resulting from environmental changes | 0.25 | 0.23 | 0.45 | 0.16 | 0.48 | 0.20 |

TABLE 4-continued

| Characteristics of charging roller | | | | | | |
|---|---|---|---|---|---|---|
| Electrical resistance (Ω) | $7.07 \times 10^6$ | $6.50 \times 10^7$ | $5.60 \times 10^7$ | $1.95 \times 10^6$ | $5.89 \times 10^7$ | $7.13 \times 10^6$ |
| Variation resulting from electricity breakdown test | 0.162 | 0.126 | 0.137 | 0.060 | 0.133 | 0.048 |
| Bleeding in electricity breakdown test | Pass | Pass | Pass | Fail | Pass | Fail |

*1: 1-hexyl-3-methylimidazolium

Comparative Examples 1 and 2 had the problem of the bleeding of the imidazolium ion carrier or the ammonium ion carrier after the electricity breakdown test. Comparative Example 2, in which the anionic species of the ion carrier was a chloride ion, also had the problems of insufficient reduction in electrical resistance and large variations in electrical resistance resulting from the electricity breakdown test. Furthermore, variations in electrical resistance resulting from environmental changes were also relatively large.

Comparative Examples 3 to 5, in which all the alkyl groups bonded to the phosphorus atom of the cation of the ion carrier were the same, exhibited insufficient reduction in electrical resistance. There was also the problem of large variations in electrical resistance resulting from the electricity breakdown test. Comparative Examples 3 and 5, in which the anionic species of the ion carrier was a chloride ion, also had the problem of large variations in electrical resistance resulting from environmental changes.

Comparative Examples 6 and 7, in which the anionic species of the ion carrier were a p-toluenesulfonate ion and a bromide ion, respectively, exhibited insufficient reduction in electrical resistance. Comparative Example 7, in which the anionic species of the ion carrier was a bromide ion, also had the problem of large variations in electrical resistance resulting from environmental changes.

Comparative Example 8, in which the cation species of the ion carrier had a small number of carbon atoms, had the problem of large variations in electrical resistance resulting from the electricity breakdown test. Comparative Example 9, in which the cation species of the ion carrier had a large number of carbon atoms, exhibited insufficient reduction in electrical resistance.

Comparative Examples 10 and 12, in which the amount of ion carrier was small, exhibited insufficient reduction in electrical resistance. Comparative Examples 11 and 13, in which the amount of ion carrier was large, had the problem of the bleeding of the ion carrier after the electricity breakdown test.

In contrast, the working examples exhibited low volume resistivity and, after the electricity breakdown test, achieved reduction of an increase in volume resistivity and reduction of the bleeding of the ion carrier. If the variation in volume resistivity resulting from the electricity breakdown test is reduced from conventional 0.2 to 0.1 as in the examples, the service period of the charging roller doubles. Thus, the charging rollers according to the examples can be used for a longer period than before. Furthermore, reduction of the bleeding of the ion carrier in the examples allows the charging roller to be used for a longer period of time than before and allows reduction of the thickness of the base layer (dielectric layer) of the charging roller, thereby reducing the diameter of the charging roller.

In comparison of the examples, Examples 3 and 14, in which the amount of particular ion carrier was slightly high (10 phr), tend to produce smaller effects of reducing the bleeding of the ion carrier than the other examples.

Examples 4 to 6 were different in the thickness of the sheet sample and different in the thickness of the base layer of the charging roller. In Examples 4 to 6, it was demonstrated that as these thicknesses increased, variations in electrical resistance resulting from the electricity breakdown test tended to decrease, but variations in electrical resistance resulting from environmental changes tended to increase.

In comparison of Examples 1 to 3 and 7 to 11 with Examples 12 to 19, it was demonstrated that TFSI of the two anionic species could more effectively reduce variations in electrical resistance resulting from environmental changes.

Although the embodiments of the present invention had been described in detail, the present invention is not limited to these embodiments, and various modifications may be made in the embodiments without departing from the gist of the present invention.

What is claimed is:

1. An electroconductive rubber composition for electrophotographic apparatuses, comprising:

(a) a polar rubber having an unsaturated bond or an ether bond, (b) an ion carrier containing one or more phosphonium salts selected from the group consisting of phosphonium salts having the formula (1) and phosphonium salts having the formula (2), and (c) a cross-linker, wherein the amount of (b) ranges from 0.1 to 10 parts by mass per 100 parts by mass of the (a)

$$[(H_9C_4)_3(C_nH_{2n+1})P]^+.(CF_3SO_2)_2N^- \quad (1)$$

(wherein n is an integer in the range of 8 to 16)

$$[(H_9C_4)_3(C_nH_{2n+1})P]^+.(CF_3SO_3)^- \quad (2)$$

(wherein n is an integer in the range of 8 to 16).

2. A charging roller for use in electrophotographic apparatuses, comprising a dielectric layer formed of a cross-linked form of an electroconductive rubber composition according to claim 1.

3. The charging roller for use in electrophotographic apparatuses according to claim 2, wherein the dielectric layer has a thickness in the range of 0.1 to 10 mm.

* * * * *